US011732907B2

(12) United States Patent
Hornbacher

(10) Patent No.: US 11,732,907 B2
(45) Date of Patent: Aug. 22, 2023

(54) PROTECTIVE ROOFING SHIELD AND METHOD OF USE

(71) Applicant: Michael D. Hornbacher, Norfolk, NE (US)

(72) Inventor: Michael D. Hornbacher, Norfolk, NE (US)

( * ) Notice: Subject to any disclaimer, the term of this patent is extended or adjusted under 35 U.S.C. 154(b) by 0 days.

(21) Appl. No.: 17/563,300

(22) Filed: Dec. 28, 2021

(65) Prior Publication Data

US 2022/0120453 A1 Apr. 21, 2022

Related U.S. Application Data

(62) Division of application No. 17/029,536, filed on Sep. 23, 2020, now Pat. No. 11,226,121.

(51) Int. Cl.
*F24F 1/58* (2011.01)

(52) U.S. Cl.
CPC ..... *F24F 1/58* (2013.01)

(58) Field of Classification Search
CPC ..... F24F 1/58
See application file for complete search history.

(56) References Cited

U.S. PATENT DOCUMENTS

| | | | | |
|---|---|---|---|---|
| 4,815,530 | A | 3/1989 | Scott | |
| 5,097,678 | A | 3/1992 | Aubuchon | |
| 5,158,486 | A | 10/1992 | Tamame | |
| 5,226,264 | A | 7/1993 | Walters | |
| 6,186,158 | B1 | 2/2001 | Goarin | |
| 6,397,617 | B1 | 6/2002 | Johnson | |
| D469,545 | S | 1/2003 | Omanson | |
| 6,530,954 | B1 | 3/2003 | Eckmiller | |
| 6,708,514 | B1 | 3/2004 | Miller | |
| 7,140,194 | B1 | 11/2006 | Miller | |
| D625,025 | S | 9/2010 | Colmore-Williams | |
| 7,836,653 | B1 * | 11/2010 | Herrington | F24F 1/58 49/51 |
| 8,502,182 | B2 | 8/2013 | Kuhn | |

(Continued)

FOREIGN PATENT DOCUMENTS

| | | |
|---|---|---|
| CN | 206919220 | 1/2018 |

OTHER PUBLICATIONS

AC Guard Air Conditioner Cages, https://ac-guard.com/products/.

*Primary Examiner* — Schyler S Sanks
(74) *Attorney, Agent, or Firm* — McGrath North Mullin & Kratz, PC LLO; Luke C. Holst

(57) ABSTRACT

The present invention relates in general to the protection of central air conditioning systems during roof demolition and replacement, and more specifically, to a protective roofing shield for an outdoor air conditioning unit and method of use. One aspect of the protective roofing shield includes a framework and canopy that partially encloses the outdoor air conditioning unit to guard against falling debris while not obstructing air flow to the outdoor air conditioning unit to prevent damage to the unit. The protective roofing shield may be adjustable in height and length to be compatible with different sizes, manufacturers and locations of outdoor air conditioning units. The protective roofing shield and method of use is designed to be easily assembled, disassembled, and conveniently transported from one roofing job site to another by a single user to improve efficiency for a roofing contractor.

20 Claims, 7 Drawing Sheets

(56) References Cited

U.S. PATENT DOCUMENTS

| | | | |
|---|---|---|---|
| 8,671,851 | B1 | 3/2014 | Minervini |
| D706,685 | S | 5/2014 | Collins |
| 8,783,309 | B2 | 7/2014 | Betlem |
| D779,680 | S | 2/2017 | Michael |
| 10,145,570 | B2 | 12/2018 | Johnson |
| 10,214,938 | B2 | 2/2019 | Pan |
| D914,240 | S | 3/2021 | Pan |
| 11,226,121 | B1 | 1/2022 | Hornbacher |
| 2003/0226369 | A1 | 12/2003 | Comanescu et al. |
| 2004/0221776 | A1 | 11/2004 | Martin |
| 2007/0204945 | A1 | 9/2007 | Ross |
| 2009/0249842 | A1 | 10/2009 | Coon |
| 2013/0005238 | A1 | 1/2013 | Brandt |
| 2013/0174882 | A1 | 7/2013 | Ellenbecker |
| 2016/0061483 | A1 | 3/2016 | DeLano |
| 2017/0074526 | A1 | 3/2017 | Colantuoni et al. |
| 2019/0353394 | A1 | 11/2019 | Bush |

* cited by examiner

PROTECTIVE ROOFING SHIELD AND METHOD OF USE

CROSS REFERENCE TO RELATED APPLICATIONS

This application is a divisional of U.S. patent application Ser. No. 17/029,536 filed Sep. 23, 2020, herein incorporated by reference in its entirety.

FIELD OF THE INVENTION

The present invention relates in general to the protection of central air conditioning systems during roof demolition and replacement. More specifically, the purpose of the invention is to provide a protective roofing shield for an outdoor air conditioning unit, and optionally flowers, trees, shrubs or landscaping, from falling debris that commonly occurs during roof replacement. The purpose of the invention is to also provide a protective roofing shield for an outdoor air conditioning unit and method of use that is easy to set up with a single person, transportable and does not obstruct air flow to the outdoor air conditioning unit.

BACKGROUND OF THE INVENTION

Central air conditioner systems are used to cool and maintain a desired indoor temperature at a residence or business during warmer weather. Central air conditioner systems typically comprise an indoor air conditioning unit located inside a building to be cooled and an outdoor air conditioning unit located outside the building. These units are connected by plumbing, electrical wiring, and ductwork, which also flows throughout the building where the central air conditioner unit is utilized. Generally speaking, the indoor air conditioning unit functions to extract beat from its surroundings, wherein this beat is expelled outside of the building through the outdoor air conditioning unit.

The outdoor air conditioning unit ("OACU") in particular comprises a compressor, a condenser, a grill, piping, valves, and a fan all enclosed within a housing. The fan operates in cooperation with the compressor to assist in heat removal. The OACU is typically located near a building it serves to maximize the efficiency of the central air conditioning, system. Constant exposure of the OACU to direct sunlight and harsh environmental conditions (e.g., rain, hail, snow, dust, leaves, grass, etc.) may impede the efficiency of the central air conditioner system and reduce the overall working lifespan of the OACU. Thus, for these reasons the OACU is often placed immediately adjacent to the building it serves and under the eaves of the roof to help provide protection against the sun and outside elements.

This location causes significant problems for roofing contractors. Roof replacement typically involves tearing-off old, worn out shingles from the roof and replacing them with a layer of new shingles. After removal of the old shingles from the roof during demolition, they are often tossed to the ground to be cleaned up later and disposed. Falling shingles and other debris can cause significant damage to the OACU, including flowers, trees, shrubs and landscaping, which are easily damaged from falling objects.

For these reasons, roofing contractors may cover the OACU with a tarp, plywood, or couch cushion in an attempt to protect the OACU during demolition. Such make-shift coverings often fail to provide the requisite level of protection needed to safe-guard the OACU and may instead cause further damage to the OACU by blocking air flow to the unit.

Repairing and/or replacing a damaged OACU, including flowers, trees, shrubs and landscaping, results in a significant and unexpected cost for the roofing contractor. Moreover, roof replacement typically occurs during the summer months when the central air conditioner system is most needed. The central air conditioner system must therefore remain operational during roof replacement. If the OACU is damaged during roofing demolition and requires immediate repairs because of hot weather, this compounds the expense to the roofing contractor for having to pay for emergency air conditioner services. In such instances, the reputation of the roofing contractor also suffers as inconvenienced customers become frustrated with the perceived lack of care taken to protect their personal property.

Thus, a desire remains to provide an effective protective roofing shield for an OACU, and optionally flowers, trees, shrubs and landscaping, during roof replacement. A desire also remains to provide a protective roofing shield and method of use that allows the central air conditioner system to remain operational during roof replacement without obstructing air How to the OACU. A desire further remains to provide a protective roofing shield and method of use that may be easily set up, taken down and transported from job site to job site by a single person. A desire also remains to provide a protective roofing shield that may be adjustable in height or length to account for varying sizes of OACUs or uneven terrain. A desire still further remains to provide a protective roofing shield that includes advertising space for the roofing contractor so that potential customers may lake note of the roofing contractor's due care taken to protect their client's personal property and to promote a job well done.

BRIEF SUMMARY OF THE INVENTION

Therefore, it is a principal object, feature, and/or advantage of the present disclosure to overcome the aforementioned deficiencies in the art and provide protection to a central air conditioning system during roof replacement.

Another object, feature, and/or advantage of the present disclosure is to provide a freestanding protective roofing shield for an OACU, and optionally flowers, trees, shrubs or landscaping, from failing debris that commonly occurs during roof replacement.

Yet another object, feature, and/or advantage of the present disclosure is to provide a protective roofing shield and method of use that allows the central air conditioner system to remain operational during roof replacement without obstructing air flow to the OACU.

A further object, feature, and/or advantage of the present disclosure is to provide a protective roofing shield and method of use that may be easily assembled, disassembled, and conveniently transported from one roofing job site to another roofing job site by a single person to improve efficiency for a roofing contractor.

A still further object, feature, and/or advantage of the present disclosure is to provide a protective roofing shield that may be adjustable in height or length to account for varying sizes of OACUs.

Another object, feature, and/or advantage of the present disclosure is to provide a protective roofing shield with legs that are individually adjustable in height to allow the protective shield to be utilized on uneven terrain.

Yet another object, feature, and/or advantage of the present disclosure is to provide a protective roofing shield that includes advertising space for the roofing contractor.

A further object, feature, and/or advantage of the present disclosure is to provide a protective roofing shield and method that may be used with ail types, sizes, models and manufacturers of OACUs.

A still further object, feature, and/or advantage of the present disclosure is to provide a protective roofing shield that is inexpensive, value-priced and thus affordable to roofing contractors.

Another object, feature, and/or advantage of the present disclosure is to provide a protective roofing shield that is reusable and comprised of lightweight and durable materials.

These and/or other objects, features, and/or advantages of the present disclosure will be apparent to those skilled in the an. The present disclosure is not to be limited to or by these objects, features, and advantages. No single aspect need provide each and every object, feature, or advantage.

According to one aspect of the present disclosure, a protective roofing shield is provided. The protective roofing shield may comprise a canopy and a framework configured to cover and protect an OACU from falling debris that may occur during roof demolition and replacement. In particular, the canopy of the protective roofing shield may be configured to cover and optionally extend beyond a top portion of the OACU to provide protection from falling debris. The framework may be configured to enclose the OACU on only three sides to protect the unit from falling debris while not obstructing air flow to the OACU. The framework may also include advertising space to be utilized by a roofing contractor to promote their services. In this aspect, the framework may be fixed in height to improve stability of the protective roofing shield.

According to another aspect of the present disclosure, a plurality of add-on leg extensions may be provided and utilized with the protective roofing shield. In particular, five plurality of leg extensions may be configured to increase and adjust the height of the protective roofing shield to fit a variety of types, sizes, models and manufacturers of OACUs. Each leg extension of the plurality of leg extensions may also be independently height adjustable so that the protective roofing shield may be utilized on uneven or sloped terrain.

According to a further aspect of the present disclosure, a protective roofing shield is provided. The protective roofing shield may comprise a canopy and a framework configured to cover and protect an OACU from failing debris that may occur during roof demolition and replacement. In particular, the canopy of the protective roofing shield may be configured to cover and optionally extend beyond a top portion of the OACU to provide protection from failing debris. The framework may be configured to enclose the OACU on only three sides to protect the unit from falling debris while not obstructing air flow to the OACU. The framework may also include advertising space to be utilized by a roofing contractor to promote their services. In this aspect, the framework may comprise a plurality of legs wherein each leg may have a telescoping portion and a locking mechanism. The telescoping portions and locking mechanisms of the plurality of legs may be utilized to increase and adjust the height of the protective roofing shield to fit a variety of types, sizes, models and manufacturers of OACUs. Each leg of the plurality of legs may also be independently height adjustable so that the protective roofing shield may be utilized on uneven or sloped terrain.

According to another aspect of the present disclosure, a method of using the protective roofing shield of the present disclosure is provided. The method may include providing a residence or business that needs roof demolition and replacement, wherein the residence or business has an OACU. The method may include transporting a disassembled protective roofing shield to the job site of the residence or business. The method may further comprise assembling the framework of the protective roofing shield. Using the horizontal front panel of the framework, spacing may be adjusted between the first vertical side support and the second vertical side support to fit the framework to the corresponding size of the OACU. The height of the protective roofing shield may also be adjusted to fit to the corresponding height of the OACU and to take into account uneven or sloped terrain. The assembled framework may then be set in place to enclose the OACU on three sides. The canopy of the protective roofing shield may be removably attached or set on top of the framework to cover and provide protection from falling debris. The method may further include demolition and replacement of the roof, wherein the protective roofing shield protects the OACU, and optionally flowers, trees, shrubs or landscaping, from falling debris. After demolition and replacement of the roof, the protective roofing shield may be disassembled and transported to the next job site to protect another OACU from falling debris during roof demolition and replacement.

Different aspects may meet different objects of the disclosure. Other objectives and advantages of this disclosure will be more apparent in the following detailed description taken in conjunction with the figures. The present disclosure is not to be limited by or to these objects or aspects. It is to be understood that both the foregoing general description and the following detailed description are exemplary and explanatory only and are not necessarily restrictive of the present disclosure. The accompanying figures, which are incorporated in and constitute a part of the specification, illustrate subject matter of the disclosure. Together, the descriptions and the figures serve to explain the principles of the disclosure.

DESCRIPTION OF FIGURES

FIG. 1 is an isometric front-top-left side view of one aspect of the protective roofing shield of the present disclosure.

FIG. 2 is a front view of the protective roofing shield of FIG. 1.

FIG. 3 is a left side view of the protective roofing shield of FIG. 1, wherein the right side view is a mirror image.

FIG. 4 is a rear view of the protective roofing shield of FIG. 1.

FIG. 5 is an isometric front-top-left side view of the protective roofing shield of FIG. 1 comprising a plurality of add-on leg extensions removably attached to the legs.

FIG. 6 is an isometric front-top-left side view of another aspect of the protective roofing shield of the present disclosure.

FIG. 7 is a front view of the protective roofing shield of FIG. 6.

FIG. 8 is a left side view of the protective roofing shield of FIG. 6, wherein the right side view is a mirror image.

FIG. 9 is a rear view of the protective roofing shield of FIG. 6.

DETAILED DESCRIPTION OF THE INVENTION

Referring generally to FIGS. 1-9, the present disclosure is directed to a freestanding protective roofing shield and method of use for protecting an OACU, and optionally flowers, trees, shrubs or landscaping, from fulling debris that commonly occurs during roof demolition and replacement.

Figure 1:
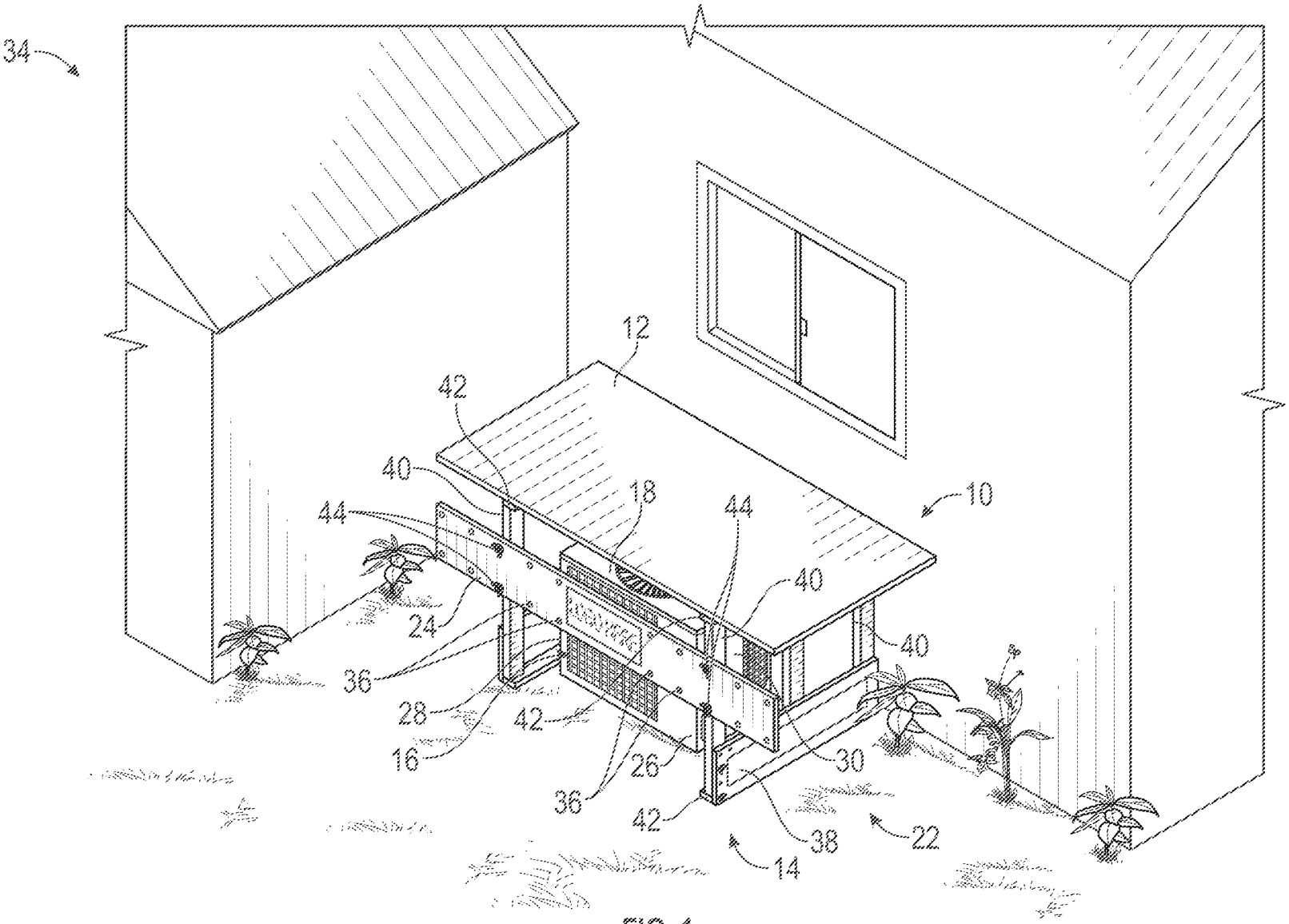
FIGS. 1-9 represent examples of the protective roofing shield of the present disclosure, and a method of using the protective roofing shield.

FIG. 1 illustrates an isometric front-top-left side view of one aspect of the protective roofing shield (10) of the present disclosure. The protective roofing shield (10) may comprise a canopy (12) and a framework (14). The canopy (12) and the framework (14) of the protective roofing shield (10) are configured to cover and protect an OACU (16) from falling debris that may occur during roof demolition and replacement. The canopy (12) and the framework (14) of the protective roofing shield (10) are also configured to partially enclose the OACU (16) and thus not obstruct air flow to the OACU (16) to prevent further damage to the unit. The canopy (12) and the framework (14) of the protective roofing shield (10) may also be used to cover and protect flowers, trees, shrubs and/or landscaping from falling debris that nay occur during roof demolition and replacement. The canopy (12) and the framework (14) of the protective roofing shield (10) may be composed of wood, plastic, aluminum, metal, steel, fiberglass, vinyl or combinations thereof that are lightweight and durable in nature to provide robust protection to the OACU (16) from failing debris and to withstand harsh outdoor conditions when in use.

Shown in FIG. 1, the canopy (12) of the protective roofing shield (10) may be configured to cover and optionally extend beyond a top portion (18) of the OACU (16) to provide protection from falling debris. The canopy (12) may range approximately 4-8 feet in length and approximately 4-6 feet in width. As shown in FIG. 1, the canopy (12) may be formed of a single, flat piece of material. Alternatively, the canopy (12) may be formed of multiple, flat pieces arranged side by side on top of the framework (14) to assist in ease of assembly, disassembly and transport. In this example, the multiple, flat pieces of the canopy (12) may be independent from one another or alternatively connected, for example, via hinges, straps, or brackets. There is configured to be sufficient spacing (e.g., approximately 2-4 feet) between the canopy (12) and the top portion (18) of the OACU (16) to not obstruct air flow to the OACU (16). The canopy (12) may simply rest on the top of the framework (14) without being permanently or removably attached. Alternatively, the canopy (12) may be removably attached to the framework (14) via an attachment member (44). It is contemplated by the present disclosure that suitable attachment members (44) may include (or example, but are not limited to, screws, fasteners, nuts/bolts, wing nuts, clamps, nails, brackets, and/or pins.

Also shown in FIG. 1, the framework (14) may comprise a first vertical side support (20) and an opposite, second vertical side support (22). The framework (14) may also include a horizontal front panel (24). The horizontal from panel (24) is configured to be removably attached to the first vertical side support (20) and the second vertical side support (22) to form the framework (14). The horizontal front panel (24) may be removably attached to the first vertical side support (20) and the second vertical side support (22) via an attachment member (44).

Further shown in FIG. 1, the framework (14) may enclose a front side (26), left side (28) and right side (30) of the OACU (16). In particular, the first vertical side support (20) of the framework (14) may be located adjacent the left side (28) of the OACU (16), whereas there is sufficient spacing (e.g., approximately 2-4 feet) between the first vertical side support (20) and the left side (28) to not obstruct air flow to the OACU (16). The second vertical side support (22) may be located adjacent a right side (30) of the OACU (16), whereas there is also sufficient spacing (e.g., approximately 2-4 feet) between the second vertical side support (22) and right side (30) to not obstruct air flow to the OACU 116). Thus, the first vertical side support (20) and the second vertical side support (22) may be located on opposite sides (26, 28) of the OACU (16). The horizontal front panel (24) may be located adjacent the front side (26) of the OACU (16), whereas there is sufficient spacing (e.g., approximately 2-4 feet) between the horizontal from panel (24) and the from side (26) to not obstruct air flow to the OACU (16). The framework (14) is thus configured to enclose the OACU (16) on only three sides to protect the unit from falling debris while not obstructing air flow to the OACU (16).

Figure 2:
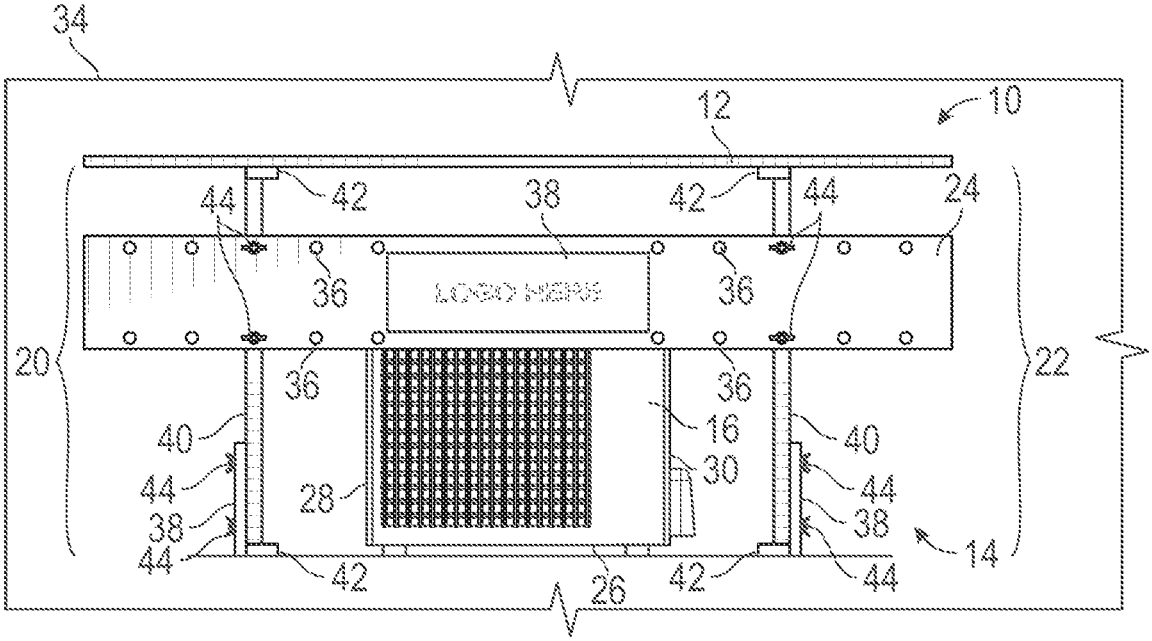

FIG. 2 illustrates a front view of the protective roofing shield (10) of the present disclosure. In particular, the horizontal front panel (24) may cover all or a portion of the from side (26) of the OACU (16), and optionally extend beyond the front side (26), to provide protection to the OACU (16) from failing debris during roofing demolition. The horizontal from panel (24) may range approximately 4-8 feet in length and approximately 1-3 feel in width. The horizontal front panel (24) may also comprise at least one series of holes (36) traversing through the horizontal front panel (24), wherein each hole of the at least one series of holes (36) may be spaced approximately 2-12 inches apart. Attachment members (44) may traverse through a plurality of holes of the at least one series of holes (36) for removably attaching the horizontal front panel (24) to the first vertical side support (20) and the second vertical side support (22) to form the framework (14). The at least one series of holes (36) may also be used to adjust spacing between the first vertical side support (20) and the second vertical side support (22) of the framework (14). Such adjustability in spacing permits the protective roofing shield (10) to be utilized with varying sizes of OACUs (16), including all types, sizes, models and manufacturers of OACUs (16). The horizontal front panel (24; may also comprise advertising space (38). Such advertising space (38) may be utilized by a roofing contractor to promote their services and so that potential customers may take note of the roofing contractor's due care taken to protect their client's personal property.

Figure 3:
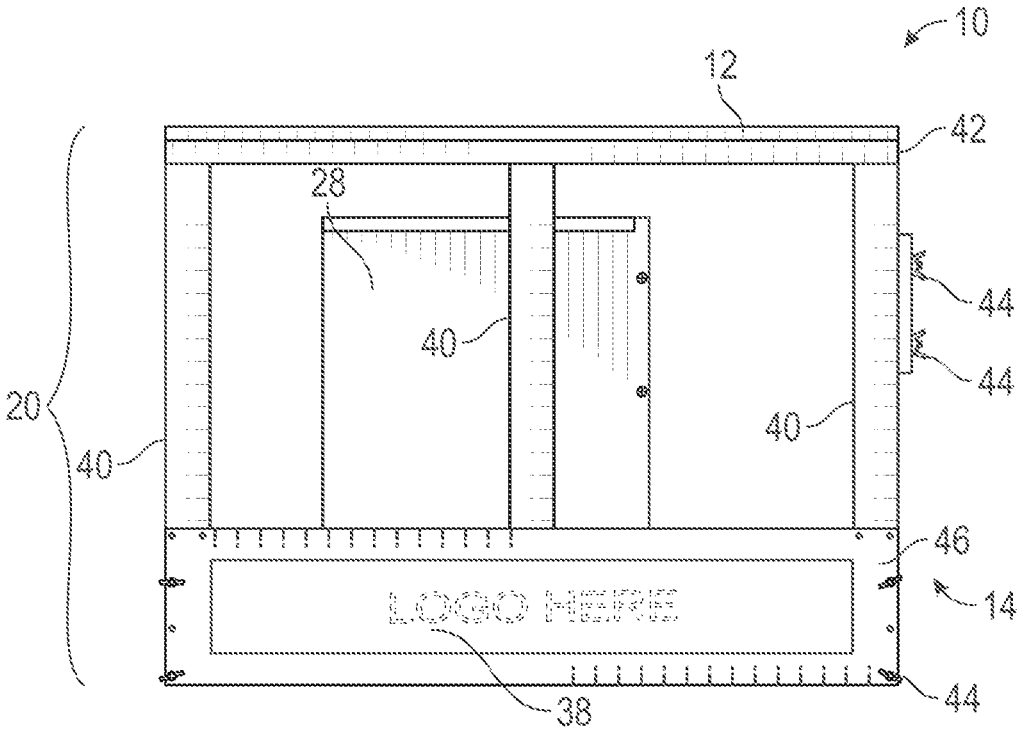

FIG. 3 illustrates a left side view of the protective roofing shield (10) of the present disclosure, wherein the right side view is a mirror image. In particular, the first and second vertical side supports (20, 22) of the framework (14) may each comprise a plurality of legs (40), at least one support bracket (42), and a horizontal side panel (44) to collectively provide stability to the protective roofing shield (10). The first and second vertical side supports (20, 22) may range approximately 4-6 feet in width and 4-6 feet in height. The at least one support bracket (42) and horizontal side panel (44) may be permanently affixed to or integrally formed with the plurality of legs (40) of the first or second vertical side supports (20, 22). Alternatively, the at least one support bracket (42) and horizontal side panel (46) may be removably attached via an attachment member (44) to the plurality of legs (40). The horizontal side panel (46) may also include advertising space (38) to be utilized by the roofing contractor to promote their services. The horizontal side panel (46) may range approximately 4-6 feet in length and approximately 1-3 feet in width. The first and second vertical side supports (20, 22) of the framework (14) may be fixed in height to improve stability of the protective roofing shield (10).

Figure 4:
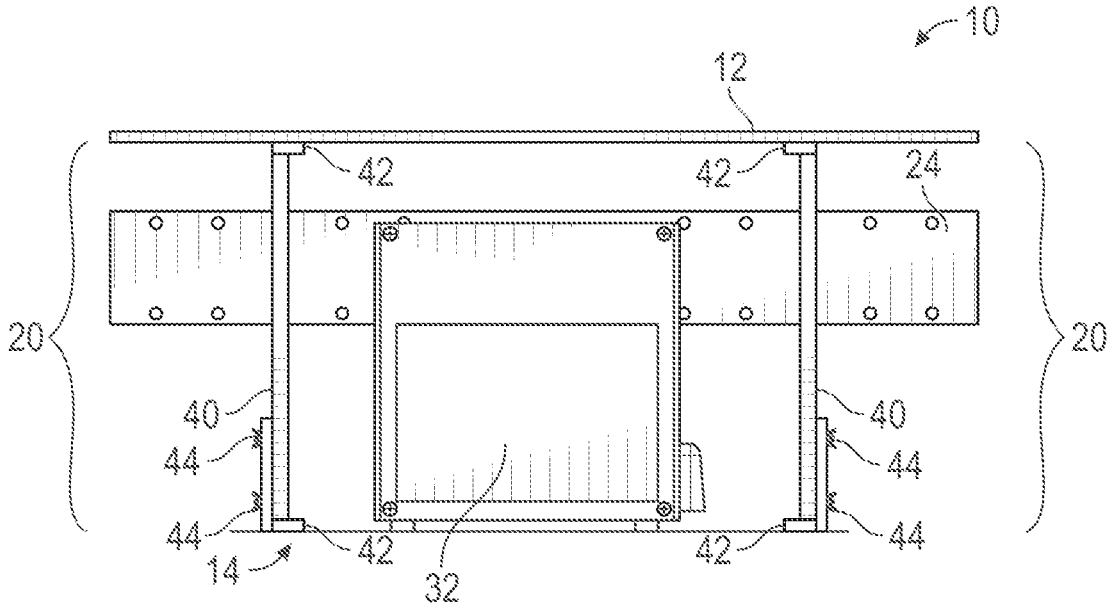

FIG. 4 illustrates a rear view of the protective roofing shield (10) of the present disclosure. In particular, the rear of the protective roofing shield (10) is left open and does not include a horizontal rear panel. It must be noted that a rear side (32) of the OACU (16) typically faces an adjacent building (34) and often includes plumbing, electrical wiring, and ductwork connecting rite OACU (16) to an indoor air conditioning unit (not shown) located inside the adjacent building (34). The rear side (32) of the OACU (16) is thus difficult to access. The three-sided configuration of the framework (14)—in addition to permitting sufficient air flow to the OACU (16)—thus conveniently permits a roofing contractor to assemble the protective roofing shield (10) around the easily accessible front side (26), left side (28), and right side (30) of the OACU (16), without having to contend with the difficult to access rear side (32) of the OACU (16) facing the adjacent building (34).

Figure 5:
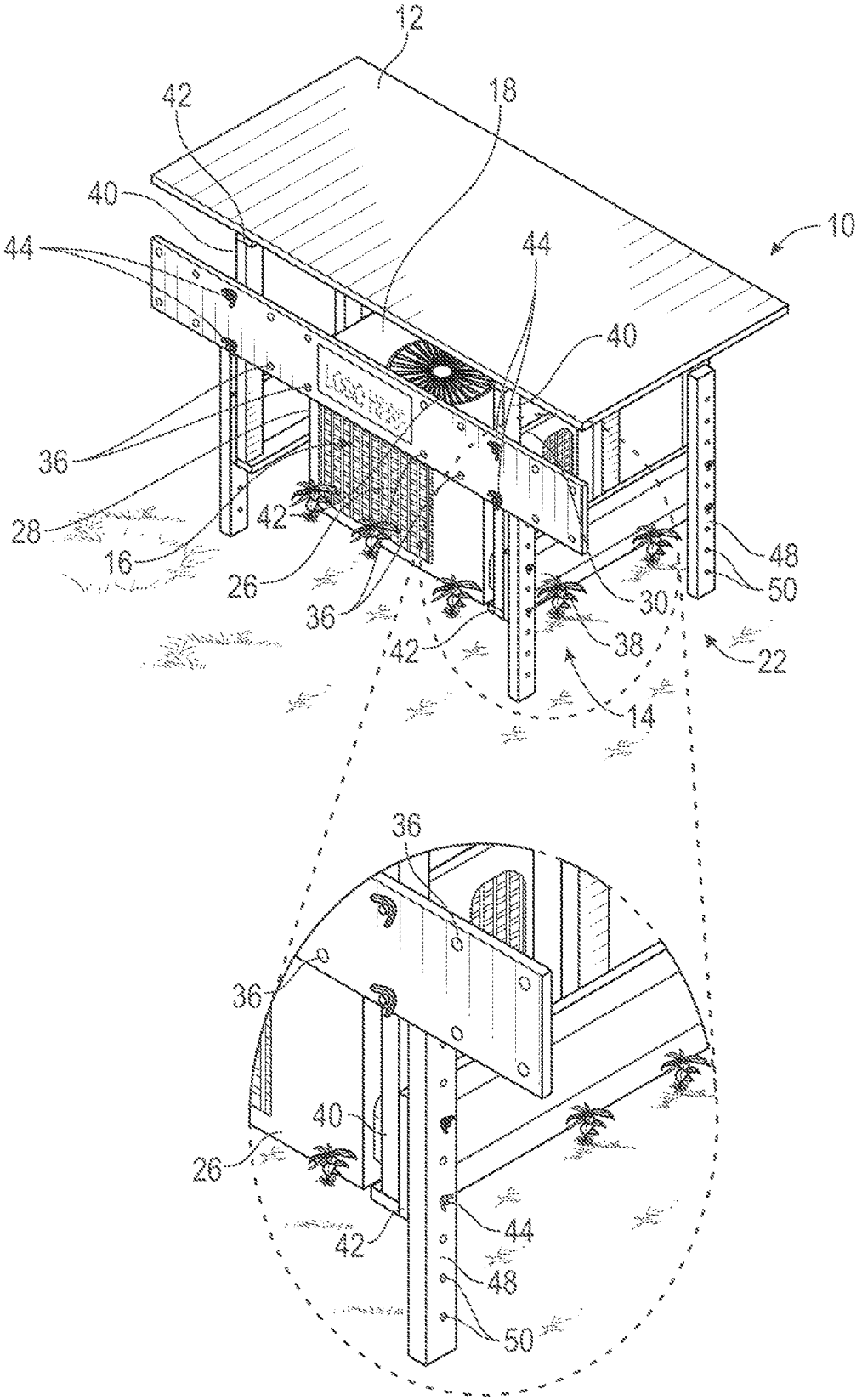

FIG. 5 illustrates another aspect of the protective roofing shield (10) of FIG. 1 further comprising a plurality of add-on leg extensions (48) removably attached to the legs (40) of the first find second vertical side supports (20, 22). The plurality of leg extensions (481 may be utilized collectively to increase and adjust the height of the protective roofing shield (10) approximately 2-4 feet to fit a variety of types, sizes, models and manufacturers of OACUs (16). Each leg extension (48) of the plurality of leg extensions (48) may also lie independently height adjustable so that the protective roofing shield (10) may be utilized on uneven or sloped terrain.

Shown in FIG. 5, each leg extension (48) may be removably attached to any leg (40) of the first or second vertical side supports (20, 22). Each leg extension (48) may be approximately 2-4 feet in length and include at least one series of holes (50) traversing through the leg extension (48). Each hole of the at least one series of holes (50) may be spaced approximately 2-12 inches apart. The at least one series of holes (50) of the leg extension (48) may be configured to align with at least two corresponding holes traversing through each leg (40). An attachment member (44) may be utilized to removably attach the leg extension (48) to the leg (40). In particular, the attachment member (44) may traverse through at least two holes of the series of holes (50) of the leg extension (48) and the at least two corresponding boles in the leg (40). By utilizing different holes of the series of holes (50) to attach the leg extension (48) to the leg (40), the height of the protective roofing shield (10) may be adjusted.

Figure 6:
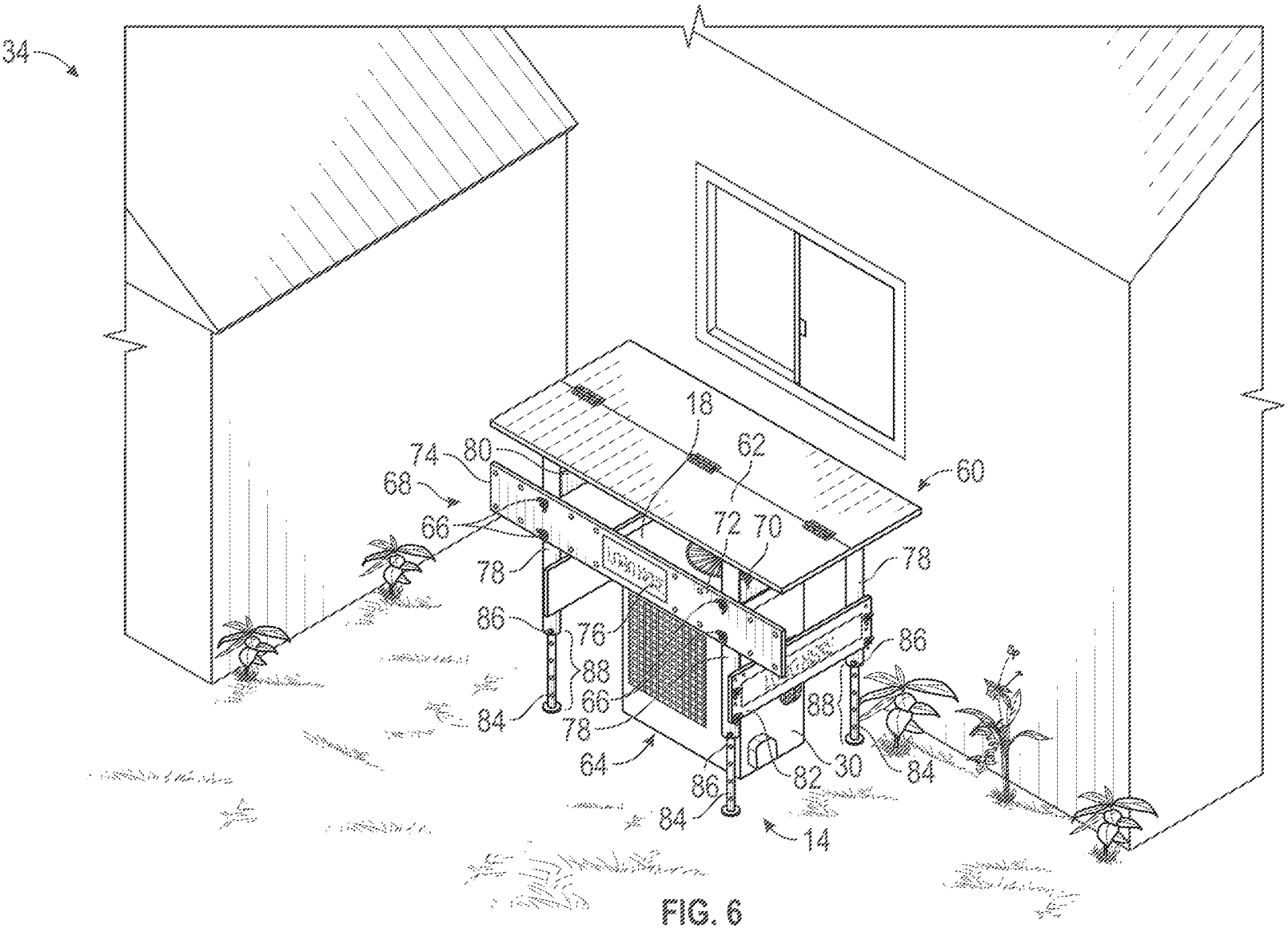

FIG. 6 illustrates an isometric front-top-left side view of another aspect of a protective roofing shield (60) of the present disclosure. The protective roofing shield (60) may comprise a canopy (62) and a framework (64). The canopy (62) and the framework (64) of the protective roofing shield (60) are configured to cover and protect the OACU (16) from falling debris that may occur during roof demolition and replacement. The canopy (62) and the framework (64) of the protective roofing shield (60) are also configured to partially enclose the OACU (16) and thus not obstruct air flow to the OACU (16) to prevent further damage to the unit. The canopy (62) and the framework (64) of the protective roofing shield (60) may also be used to cover and protect flowers, trees, shrubs and/or landscaping from fulling debris that may occur during roof demolition and replacement. The canopy (62) and the framework (64) of the protective roofing shield (60) may be composed of wood, plastic, aluminum, metal, steel, fiberglass, vinyl or combinations thereof that are lightweight and durable in nature to provide robust protection to the OACU (16) from tailing debris and to withstand harsh outdoor conditions when in use.

Shown in FIG. 6, the canopy (62) of the protective roofing shield (60) may be configured to cover and optionally extend beyond a top portion (18) of the OACU (16) to provide protection from falling debris. The canopy (62) may range approximately 4-8 feet in length and approximately 4-6 feet in width. As shown in FIG. 6, the canopy (62) may be formed of multiple, flat pieces arranged side by side on top of the framework (64) to assist in ease of assembly, disassembly and transport. In this example, the multiple, flat pieces of the canopy (62) may be independent from one another or alternatively connected, for example, via hinges, straps, or brackets. Alternatively, the canopy (62) may be formed of a single, flat piece of material. There is configured to be sufficient spacing (e.g., approximately 2-4 feet) between the canopy (62) and the top portion (18) of the OACU (16) to not obstruct air flow to the OACU (16). The canopy (62) may simply rest on the top of the framework (64) without being permanently or removably attached. Alternatively, the canopy (62) may be removably attached to the framework (64) via an attachment member (66). It is contemplated by the present disclosure that suitable attachment members (66) may include for example, but are not limited to, screws, fasteners, nuts/bolts, wing nuts, clamps, nails, brackets, and/or pins.

Also shown in FIG. 6, the framework (64) may comprise a first vertical side support (68) and an opposite, second vertical side support (70). The framework (64) may also include a horizontal front panel (72). The horizontal front panel (72) is configured to be removably attached to the first vertical side support (68) and the second vertical side support (70) to form the framework (64). The horizontal front panel (72) may be removably attached to the first vertical side support (68) and the second vertical side support (70) via an attachment member (66).

Further shown in FIG. 6, the framework (64) may enclose a front side (26), left side (28) and right side (30) of the OACU (16). In particular, the first vertical side support (68) of the framework (64) may be located adjacent the left side (28) of the OACU (16). whereas there is sufficient spacing (e.g., approximately 2-4 feet) between the first vertical side support (68) and the left side (28) to not obstruct air flow to the OACU (16). The second vertical side support (70) may be located adjacent a right side (30) of the OACU (16), whereas there is also sufficient spacing (e.g., approximately 2-4 feet) between the second vertical side support (70) and right side (30) to not obstruct air How to the OACU (16). Thus, the first vertical side support (68) and the second vertical side support (70) may be located on opposite sides (28, 30) of the OACU (16). The horizontal front panel (72) may be located adjacent the front side (26) of the OACU (16), whereas there is sufficient spacing (e.g., approximately 2-4 feet) between the horizontal front panel (72) and the front side (26) to not obstruct air flow to the OACU (16). The framework (64) is thus configured to enclose the OACU (16) on only three sides to protect the unit from tailing debris while not obstructing air flow to the OACU (16).

Figure 7:
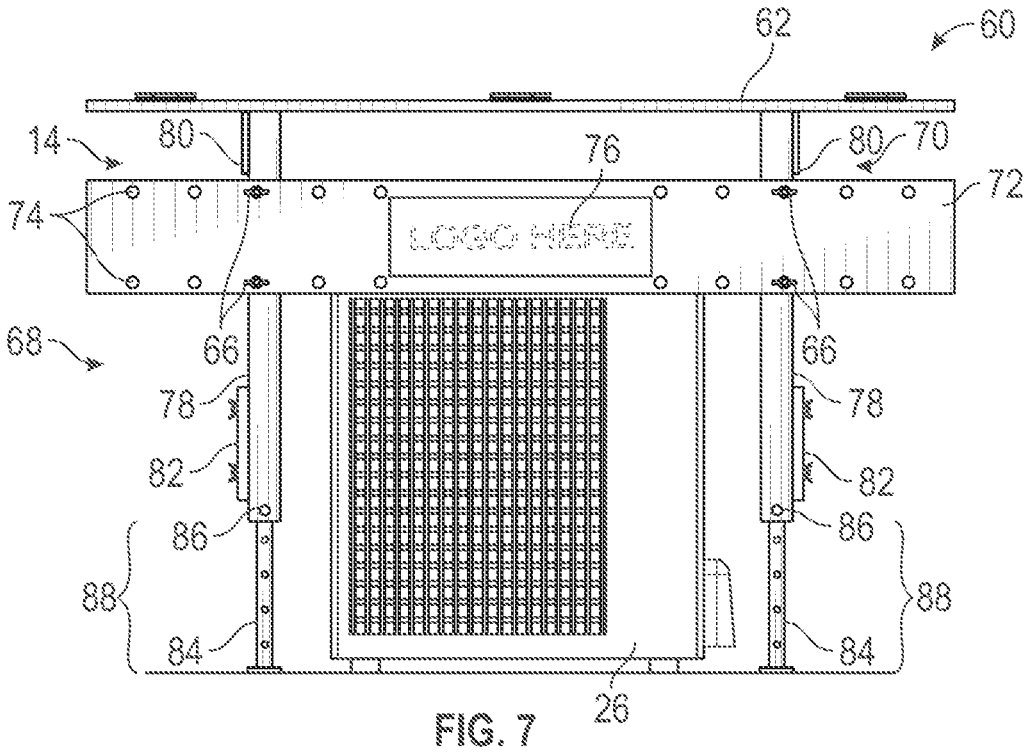

FIG. 7 illustrates a front view of the protective roofing shield (60) of the present disclosure. In particular, the horizontal front panel (72) may cover all or a portion of the front side (26) of the OACU (16). and optionally extend beyond the front side (26), to provide protection to the OACU (16) from falling debris during roofing demolition. The horizontal front panel (72) may range approximately 4-8 feet in length and approximately 1-3 feet in width. The horizontal front panel (72) may also comprise at least one series of holes (74) traversing through the horizontal front panel (72), wherein each hole of the at least one series of holes (74) may be spaced approximately 2-12 inches apart. Attachment members (66) may traverse through a plurality of holes of the at least one series of holes (74) for removably attaching the horizontal front panel (72) to the first vertical side support (68) and the second vertical side support (70) to form the framework (64). The at least one series of holes (74) may also be used to adjust spacing between the first vertical side support (68) and the second vertical side support (70) of the framework (64). Such adjustability in spacing permits the protective roofing shield (60) to be utilized with varying sizes of OACUs (16), including all types, sizes, models and manufacturers of OACUs (16). The horizontal front panel (72) may also comprise advertising space (76).

Figure 8:
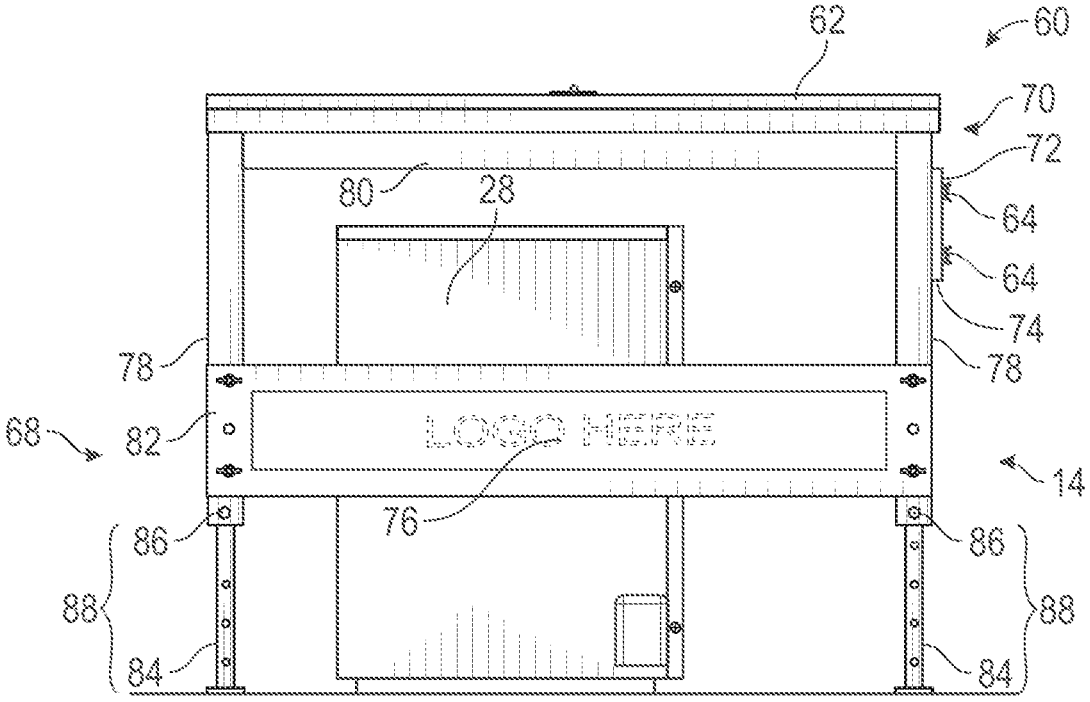

FIG. 8 illustrates a left side view of the protective roofing shield (60) of the present disclosure, wherein the right side view is a mirror image. In particular, the first and second vertical side supports (68, 70) of the framework (64) may each comprise a plurality of legs (78), at least one support bracket (80), and a horizontal side panel (82) to collectively provide stability to the protective roofing shield (60). The first and second vertical side supports (68, 70) may range approximately 4-6 feet in width and 4-6 feet in height. The at least one support bracket (80) and horizontal side panel (82) may be permanently affixed to or integrally formed with the plurality of legs (78) of the first or second vertical side supports (68, 70). Alternatively, the at least one support bracket (80) and horizontal side panel (82) may be removably attached via an attachment member (66) to the plurality of legs (78). The horizontal side panel (82) may also include advertising space (76) to be utilized by the roofing contractor to promote their services. The horizontal side panel (82) may range approximately 4-6 feet in length and approximately 1-3 feet in width.

Figure 9:
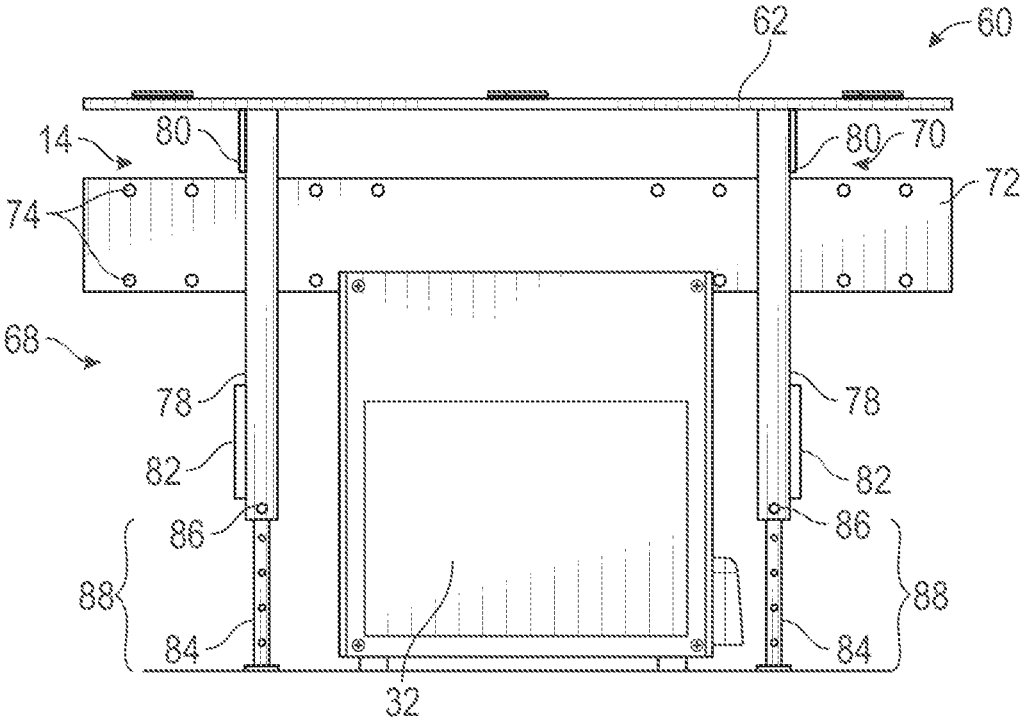

FIG. 9 illustrates a rear view of the protective roofing shield (60) of the present disclosure. In particular, the rear of the protective roofing shield (60) is left open and does not include a horizontal rear panel. It must be noted that a rear side (32) of the OACU (16) typically faces an adjacent building (34) and often includes plumbing, electrical wiring, and ductwork connecting the OACU (16) to an indoor air conditioning unit (not shown) located inside the adjacent building (34). The rear side (32) of the OACU (16) is thus difficult to access. The three-sided configuration of the framework (64)—in addition to permitting, sufficient air flow to the OACU (16)—thus conveniently permits a roofing contractor to assemble the protective roofing shield (60) around the easily accessible from side (26), left side (28), and right side (30) of the OACU (16), without having to contend with the difficult to access rear side (32) of the OACU (16) facing the adjacent building (34).

Shown in FIGS. 6-9, each leg (78) of the plurality of legs (78) may comprise a telescoping portion (84) and a locking mechanism (86). The telescoping portions (84) and locking mechanisms (86) of the plurality of legs (78) may be utilized collectively to increase and adjust the height of the protective roofing shield (60) approximately 2-4 feet to fit a variety of types, sizes, models and manufacturers of OACUs (16). Each leg (78) of the plurality of legs (78) may also be independently height adjustable so that the protective roofing shield (60) may be utilized on uneven or sloped terrain.

Further shown in FIGS. 6-9, each leg (78) of the plurality of legs (78) may be hollow and tubular in shape wherein the telescoping portion (84) is configured to fit and slide inside each leg (78). It is contemplated by the present disclosure that the hollow and tubular shape of each leg (78) may be round, square, rectangle, triangular, pentagon, hexagonal octagonal or other tubular shapes. The telescoping portion (84) may be approximately 2-4 feet in length and include at least one series of holes (88) traversing through the telescoping portion (84). Each hole of the at least one series of holes (88) may be spaced approximately 2-12 inches apart. The at least one series of holes (88) of the telescoping portion (84) may be configured to align with at least one corresponding hole traversing through each leg (78). The locking mechanism (86) may be utilized to lock and unlock the telescoping portion (84) in a fixed position inside the leg (78) depending on the desired height of the protective roofing shield (60). In particular, the locking mechanism (86) may traverse through at least one hole of the series of holes (88) of the telescoping portion (84) and at least one corresponding hole in the leg (78). Suitable locking mechanisms (86) of the present disclosure may include for example, but are not limited to. screws, fasteners, nuts/bolts, wing nuts, clamps, nails, brackets, and/or pins. By utilizing a different hole of the series of holes (88) to lock the telescoping portion (84) inside the leg (78), the height of the protective roofing shield (60) may be adjusted.

Another aspect of the present disclosure is a method of using the protective roofing shield (10, 60) of FIGS. 1-9 to protect an OACU (16). In particular, the method may comprise providing a residence or business (34) that needs roof demolition and replacement, wherein the residence or business (34) has an OACU (16). The method may include transporting a disassembled protective roofing shield (10, 60) of the present disclosure to the job site of the residence or business (34) that needs roof demolition and replacement. The method may further comprise assembling the framework (14, 64) of the protective roofing shield (10, 60), wherein the horizontal front panel (24, 72) is removably attached to the first vertical side support (20, 68) and the opposite, second vertical side support (22, 70) using the attachment member (44, 66). The method may also include adjusting the spacing between the first vertical side support (20, 68) and the second vertical side support (22, 70) using the at least one series of holes (36, 74) of the horizontal front panel (24, 72), to fit the framework (14, 64) to the corresponding size of the OACU (16). The method may further comprise adjusting the height of the protective roofing shield (10, 60) to fit the corresponding size of the OACU (16). The height of the protective roofing shield (10, 60) may be adjusted using the plurality of add-on leg extensions (48) removably attached to the plurality of legs (40) or alternatively using the telescoping portion (84) and locking mechanism (86) of the plurality of legs (78). If needed, each leg (40, 78) of the plurality of legs (40, 78) may be independently adjusted in height to permit utilization of the protective roofing shield (10,60) on uneven or sloped terrain.

The assembled framework (14, 64) may then be set in place to enclose the front side (26), left side (28) and right side (30) of the OACU (16). The canopy (12, 62) of the protective roofing shield (10, 60) may be removably attached or set on top of the framework (14, 64) to cover and optionally extend beyond a top portion (18) of the OACU (16) to provide protection from falling debris. The roofing contractor may also utilize the advertising space (38, 76) on the horizontal front panel (24, 72) and the at least one support bracket (42, 80) to promote their services.

The method may further include demolition and replacement of the roof, wherein the protective roofing shield (10, 60) protects the OACU (16), and optionally flowers, trees, shrubs or landscaping, from falling debris. After demolition and replacement of the roof, the protective roofing shield (10, 60) may be disassembled by removing the canopy (12, 62) from the framework (14, 64) and detaching the horizontal front panel (24, 72) from the first vertical side support (20, 68) and the opposite, second vertical side support (22, 70) using the attachment member (44, 66). The disassembled protective roofing shield (10, 60) may then be conveniently transported to the next job site to protect another OACU (16) from falling debris during roof demolition and replacement.

The freestanding protective roofing shield (10, 60) and method of use of the present disclosure are universally applicable to OACUs (16) of all makes, models, sizes and manufacturers. Although the disclosure has been described and illustrated with respect to preferred aspects thereof, it is not to lie so limited since changes, modifications, and combinations thereof may be made which are within the full intended scope of the disclosure.

What is claimed is:

1. A method of using a protective roofing shield, comprising:

providing a residence or business that requires roof demolition and replacement, the residence or business having an outdoor air conditioner unit;

transporting the protective roofing shield in a disassembled configuration to the residence or business, the protective roofing shield comprising:

a) a canopy configured to cover an outdoor air conditioner unit;

b) a framework removably attached to the canopy;

c) the framework having three sides, comprising:

i. a first vertical side support having a plurality of legs, at least one support bracket and a horizontal side panel;

ii. a second vertical side support having a plurality of legs, at least one support bracket and a horizontal side panel;

iii. the first vertical side support and the second vertical side support configured to be on opposite sides of the outdoor air conditioner unit; and iv. a horizontal front panel;

v. at least one series of holes traversing through the horizontal front panel;

vi. a plurality of attachment members configured to removably attach the horizontal front panel to the first vertical side support and the second vertical side support to form the framework;

d) the framework configured to partially enclose the outdoor air conditioner unit on only three sides;

e) the framework configured to be adjustable in length to partially enclose varying sizes of outside air conditioner units within the three sides of the framework; and f) the canopy and the framework of the protective roofing shield configured to protect the outdoor air conditioner unit from falling debris during roof demolition and replacement while not obstructing air flow to the outdoor air conditioner unit;

g) wherein the protective roofing shield is freestanding;

assembling the framework of the protective roofing shield;

setting the assembled framework in place to enclose three sides of the outdoor air conditioner unit;

placing the canopy on top of the framework to cover the outdoor air conditioner unit;

demolishing and replacing the roof, wherein the protective roofing shield protects the outdoor air conditioner unit from falling debris;

disassembling the protective roofing shield after demolition and replacement of the roof;

transporting the disassembled protective roofing shield to a next job site to protect another outdoor air conditioner unit from falling debris during roof demolition and replacement.

2. The method of claim 1, further comprising adjusting the length of the protective roofing shield to fit to a corresponding size of the outdoor air conditioner unit to provide protection from falling debris.

3. The method of claim 2, wherein adjusting the length of the protective roofing shield comprises:

utilizing the at least one series of holes to adjust spacing between the first vertical side support and the second vertical side support of the framework;

wherein adjusting the spacing between the first vertical side support and the second vertical side support permits the framework to be adjustable in length to partially enclose varying sizes of outside air conditioner units within the three sides of the framework.

4. The method of claim 1, further comprising adjusting a height of the plurality of legs to fit to a corresponding height of the outdoor air conditioner unit to provide protection from falling debris.

5. The method of claim 4, further comprising independently adjusting a height of each leg of the plurality of legs to permit the protective roofing shield to be utilized on uneven or sloped terrain.

6. The method of claim 1, further comprising:

placing advertisements on the horizontal front panel and/or the horizontal side panels.

7. A method of using a protective roofing shield, comprising:

transporting the protective roofing shield in a disassembled configuration to a job site, the protective roofing shield comprising:

a) a canopy;

b) a framework having three sides, comprising:

i. a first vertical side support;

ii. a second vertical side support;

iii. the first vertical side support and the second vertical side support configured to be on opposite sides of the framework; and iv. a horizontal front panel connecting the first vertical side support and the second vertical side support;

c) the horizontal front panel comprising:

i. at least one series of holes traversing through the horizontal front panel;

ii. a plurality of attachment members traversing through holes of the at least one series of holes;

iii. the plurality of attachment members configured to removably attach the horizontal front panel to the first vertical side support and the second vertical side support to form the framework;

iv. the at least one series of holes configured to adjust spacing between the first vertical side support and the second vertical side support of the framework; and v. wherein adjustability in spacing between the first vertical side support and the second vertical side support permits the framework to be adjustable in length;

assembling the protective roofing shield at the job site;

partially enclosing an object within the three sides of the framework and the canopy of the protective roofing shield;

protecting the object from falling debris at the job site using the protective roofing shield while not obstructing air flow to the object;

disassembling the protective roofing shield; and transporting the disassembled protective roofing shield to another job site.

8. The method of claim 7, further comprising placing advertisements on the horizontal front panel and/or the horizontal side panels.

9. The method of claim 7, wherein the first vertical side support and the second vertical side support of the framework each comprise:

a plurality of legs;

at least one support bracket; and a horizontal side panel;

wherein the at least one support bracket and the horizontal side panel are attached to the plurality of legs.

10. The method of claim 9, further comprising adjusting a height of the plurality of legs to fit to a corresponding height of the object to provide protection from falling debris.

11. The method of claim 9, further comprising independently adjusting a height of each leg of the plurality of legs to permit the protective roofing shield to be utilized on uneven or sloped terrain.

12. The method of claim 9, wherein each leg of the plurality of legs is fixed in height.

13. The method of claim 7, further comprising adjusting the length of the protective roofing shield to fit to a corresponding size of the object to provide protection from falling debris.

14. The method of claim 13, wherein adjusting the length of the protective roofing shield comprises:

utilizing the at least one series of holes to adjust spacing between the first vertical side support and the second vertical side support of the framework;

wherein adjusting the spacing between the first vertical side support and the second vertical side support permits the framework to be adjustable in length to partially enclose varying sizes of objects within the three sides of the framework.

15. A method of using a protective roofing shield, comprising:

transporting a protective roofing shield to a first location, the protective roofing shield comprising:

a) a canopy;

b) a framework having three sides, comprising:

i. a first vertical side support;

ii. a second vertical side support;

iii. the first vertical side support and the second vertical side support configured to be on opposite sides of the framework; and iv. a horizontal front panel connecting the first vertical side support and the second vertical side support;

v. the framework configured to be adjustable in length to partially enclose varying sizes of objects within the three sides of the framework;

c) the horizontal front panel comprising:

i. at least one series of holes traversing through the horizontal front panel;

ii. a plurality of attachment members traversing through holes of the at least one series of holes;

iii. the plurality of attachment members configured to removably attach the horizontal front panel to the first vertical side support and the second vertical side support to form the framework;

iv. the at least one series of holes configured to adjust spacing between the first vertical side support and the second vertical side support of the framework;

partially enclosing an object within the three sides of the framework and canopy of the protective roofing shield; and protecting the object at the location using the protective roofing shield.

16. The method of claim 15, further comprising:

adjusting spacing between the first vertical side support and the second vertical side support of the framework using the at least one series of holes.

17. The method of claim 16, wherein adjusting the spacing between the first vertical side support and the second vertical side support permits the framework to be adjustable in length.

18. The method of claim 15, further comprising adjusting a height of the first vertical side support and the second vertical side support to be uniform in height.

19. The method of claim 15, further comprising independently adjusting a height of each vertical side support to permit the protective roofing shield to be utilized on uneven or sloped terrain.

20. The method of claim 15, wherein the first vertical side support and the second vertical side support are fixed in height.

* * * * *